US006478587B2

(12) United States Patent
Sharples

(10) Patent No.: US 6,478,587 B2
(45) Date of Patent: Nov. 12, 2002

(54) RETRACTABLE ELECTRIC WALL OUTLET ASSEMBLY

(76) Inventor: Stanley S. Sharples, 3407 Pendelton Way, Land O Lakes, FL (US) 34639

( * ) Notice: Subject to any disclaimer, the term of this patent is extended or adjusted under 35 U.S.C. 154(b) by 0 days.

(21) Appl. No.: 09/799,747

(22) Filed: Mar. 6, 2001

(65) Prior Publication Data

US 2002/0127897 A1 Sep. 12, 2002

(51) Int. Cl.[7] ..... H01R 13/44
(52) U.S. Cl. ..... 439/131; 174/48
(58) Field of Search ..... 439/131, 132; 174/51, 67, 48; 200/51.09

(56) References Cited

U.S. PATENT DOCUMENTS 1,225,526 A * 5/1917 Thomas ..... 200/51.09
2,196,842 A * 4/1940 Strazzabosco ..... 200/51.09
3,794,956 A 2/1974 Dubreuil
4,798,916 A 1/1989 Engel et al.
4,952,160 A * 8/1990 Olsen ..... 439/142
4,991,988 A 2/1991 Snell et al.
5,023,396 A 6/1991 Bartee et al.
5,067,907 A 11/1991 Shotey
5,318,453 A * 6/1994 Hwang ..... 439/131
5,342,993 A * 8/1994 Siems ..... 174/48
5,755,582 A * 5/1998 Charlton ..... 439/131
5,912,432 A 6/1999 Thomas
5,944,542 A 8/1999 Lee
5,961,336 A 10/1999 Finlay
D420,327 S 2/2000 Byrne
6,046,405 A 4/2000 Obermann

* cited by examiner

*Primary Examiner*—Gary F. Paumen
*Assistant Examiner*—James R. Harvey
(74) *Attorney, Agent, or Firm*—Dale J. Ream

(57) ABSTRACT

A retractable electric wall outlet assembly includes a housing with an electrical box capable of retraction or extension relative to the housing. A cam member coupled to a housing back plate includes rails which alternately define deep and shallow slots. A push-button plunger is coupled to the electrical box and extends into the housing. A ratchet is positioned for movement in the cam member, the ratchet and plunger having teeth configured to engage one another upon depression of the plunger. Depression of the plunger causes its teeth to engage and move corresponding ratchet teeth along respective rails from deep slots into adjacent shallow slots where they are retained, thus positioning the electrical box in a retracted configuration. A consecutive plunger depression causes the plunger teeth to engage and move respective ratchet teeth into adjacent deep slots where they are biased to move the electrical box to an extended configuration.

17 Claims, 11 Drawing Sheets

RETRACTABLE ELECTRIC WALL OUTLET ASSEMBLY

BACKGROUND OF THE INVENTION

This invention relates generally to electric outlets and receptacles and, more particularly, to a selectively retractable and extendable electrical wall outlet assembly that can be locked in a retracted configuration for safety.

Conventional wall outlets are often disadvantageous in that electrical plugs received therein sometimes prevent items such as furniture from being positioned as desired or are inadvertently disconnected or damaged by furniture. In addition, electrical plug receptacles are a well-known hazard for curious young children who may insert their fingers or metal objects (e.g. paperclips) therein.

Various devices have been disclosed for either covering wall outlet receptacles or for plugging the receptacles to prevent insertion of fingers or objects other than electrical plugs. A pop-up electrical receptacle with a hinged cover is shown in U.S. Pat. No. 6,046,405 to Oberman and a telescopic floor outlet assembly is disclosed in U.S. Pat. No. 3,794,956 to Dubreuil. Although assumably effective for their expressed purposes, existing assemblies do not provide an electric wall outlet that is selectively retractable and extendable with consecutive depressions of a push-button plunger. Further, existing devices do not provide a simple mechanism for locking or unlocking an electrical outlet from a retracted configuration.

Therefore, it is desirable to have an electric wall outlet that is selectively retractable and extendable. Further, it is desirable to have a retractable electric wall outlet that may be locked in a retracted position so as to preclude access thereto by young children.

SUMMARY OF THE INVENTION

A retractable electric wall outlet assembly according to the present invention includes a housing having a back plate and side walls configured to be mountable to a wall structure of a dwelling or business. An electrical box having a front plate and side walls is dimensioned for retraction into or extension from the housing. The electrical box includes at least one electrical receptacle positioned along the side walls thereof for receiving electrical plugs therein. An open-ended cylindrical cam member is mounted atop a pair of legs extending forwardly from the back plate of the housing. The cam member includes a plurality of spaced apart rails extending longitudinally along an inner surface thereof, the rearward ends of each rail including an inclined configuration. The inner surface of the cam member alternately defines deep and shallow slots between adjacent rails, each shallow slot further defining a stop adjacent a rearward edge of the cam member.

A cylindrical plunger positioned for contact with the front plate of the electrical box extends into the interior space of the housing and is dimensioned to be received within the cam member. The plunger includes a plurality of teeth having inclined rearwardly disposed edges that act as guides between the rails when depressed into the cam member by a user. A ratchet is dimensioned for positioning within the cam member and includes a set of spaced apart teeth having inclined edges for engaging the teeth of the plunger. A compression spring is connected at one end to the back plate and at an opposed end to the ratchet for continuously urging the ratchet toward an extended or extensible configuration. A depression of the plunger by a user causes the inclined edges of respective plunger teeth to engage the inclined edges of the ratchet teeth positioned along respective deep slots of the cam member so as to urge the ratchet teeth along the inclined ends of the rails and into adjacent shallow slots where they are retained by the stops. A next consecutive depression of the plunger causes the inclined edges of respective plunger teeth to engage the inclined edges of the ratchet teeth now positioned in respective shallow slots so as to urge them along inclined edges of the rails and into adjacent deep slots. The spring bias of the ratchet causes the ratchet to urge the plunger and, consequently, the electrical box forward to an extended configuration wherein the front plate is displaced from the housing.

The cam member also defines a pair of opposed slots extending longitudinally along an outer surface thereof and defines a channel extending transversely partially around the outer surface adjacent a rearward edge thereof in communication with the longitudinal slots. A button member rotatably coupled to the front plate includes a pair of prongs having nubs at terminal ends thereof that are slidable along the longitudinal slots and along the channel when the button member is rotated such that the electrical box is locked in a retractable configuration when the nubs are positioned along the channel.

Therefore, a general object of this invention is to provide an electrical wall outlet assembly that is selectively retractable and extendable from a housing.

Another object of this invention is to provide an electrical wall outlet, as aforesaid, having multiple electrical receptacles configured to allow furniture to be positioned close to the outlet without interfering with electrical plugs inserted in the receptacles.

Still another object of this invention is to provide an electrical wall outlet, as aforesaid, in which the electrical receptacles are inaccessible when the electrical box is placed in a retracted configuration.

Yet another object of this invention is to provide an electrical wall outlet, as aforesaid, having a spring loaded retraction/extension mechanism for moving the electrical box between retracted and extended configurations with a push-button actuation.

A further object of this invention is to provide an electrical wall outlet, as aforesaid, in which the electrical box may be locked in the retracted configuration upon user rotation of the push-button member.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A retractable electrical wall outlet according to the present invention will now be described with reference to FIGS. 1 through 11 of the accompanying drawings.

Figure 1:
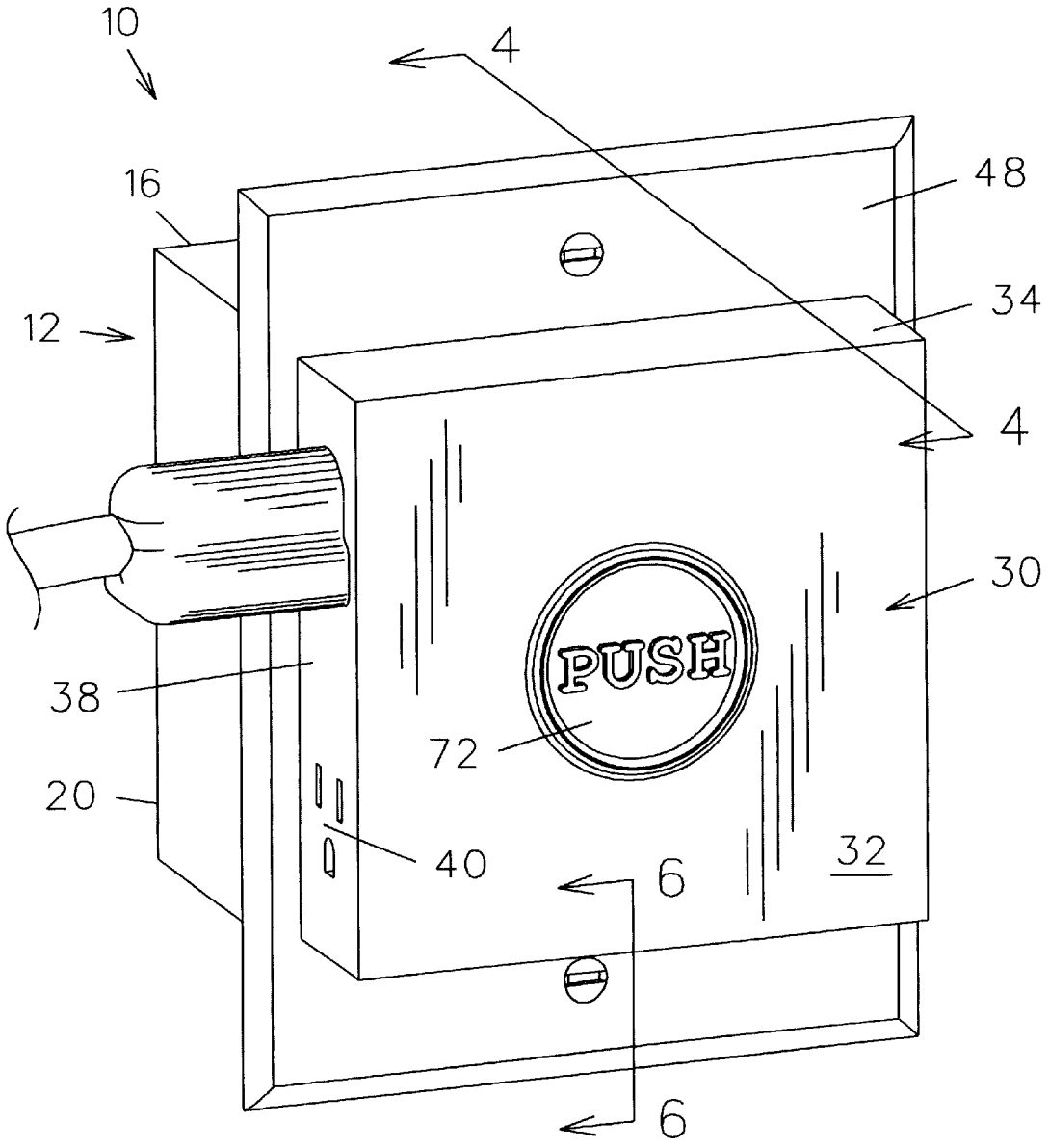
FIG. 1 a perspective view of an electrical wall outlet according to a preferred embodiment of the present invention in an extended configuration.
Figure 6:
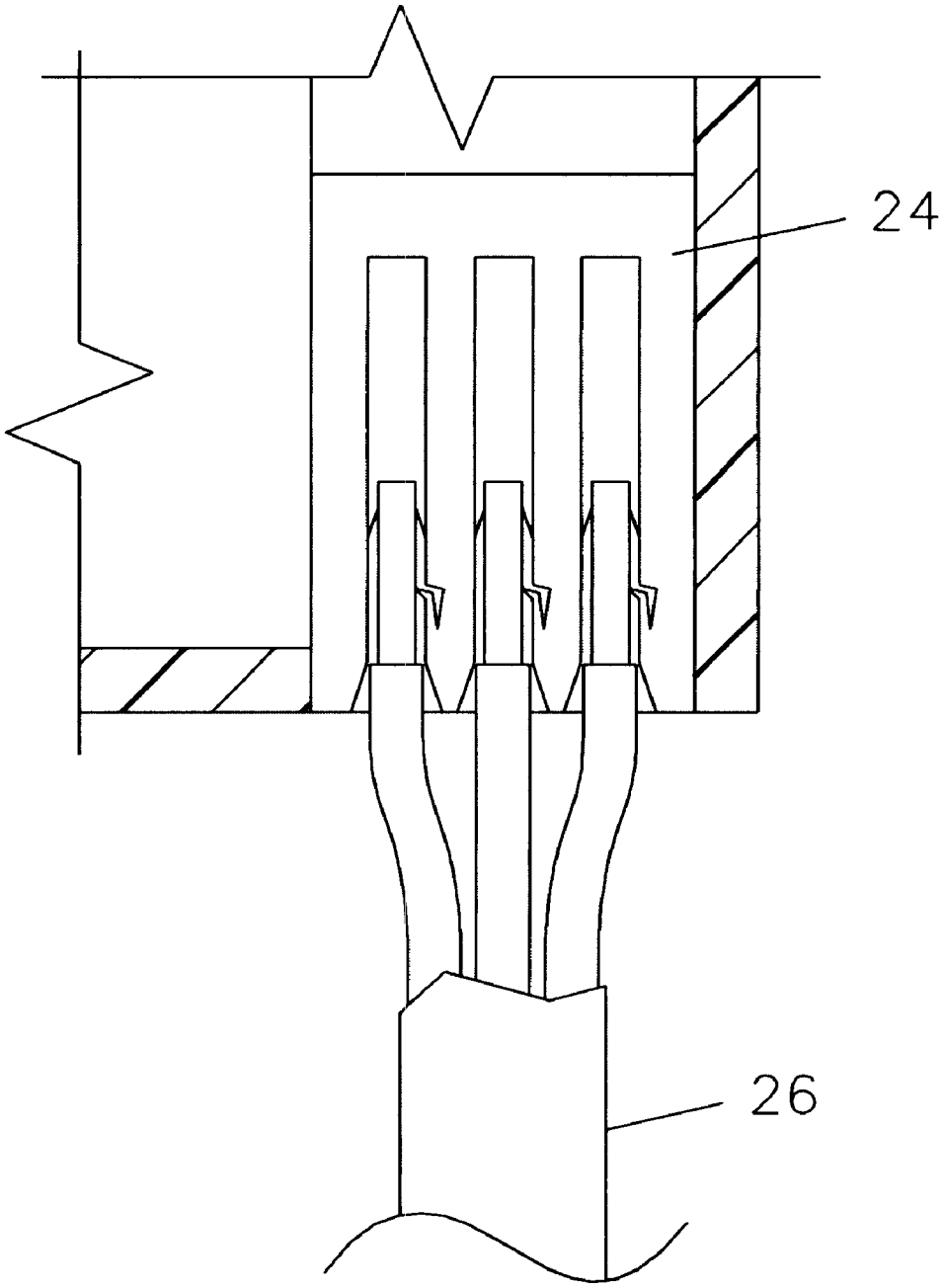
FIG. 6 is a fragmentary sectional view of the wall outlet taken along line 6—6 of FIG. 1.

A preferred embodiment 10 of the present invention includes a box-shaped housing 12 having a back plate 14 with top 16, bottom 18, and side 20 walls extending forwardly therefrom so as to define an open front and an interior space. Top 16 and bottom 18 walls include tabs 22 for attachment to a wall structure of a dwelling or business in a conventional manner (FIG. 1). The housing walls will hereafter be referred to generically as side walls. Terminal blocks 24 are mounted to the back plate 14 of the housing 12 (FIG. 4) for connection to electrical service wires 26 of the house or building where the wall outlet is installed (FIG. 6).

Figure 4:
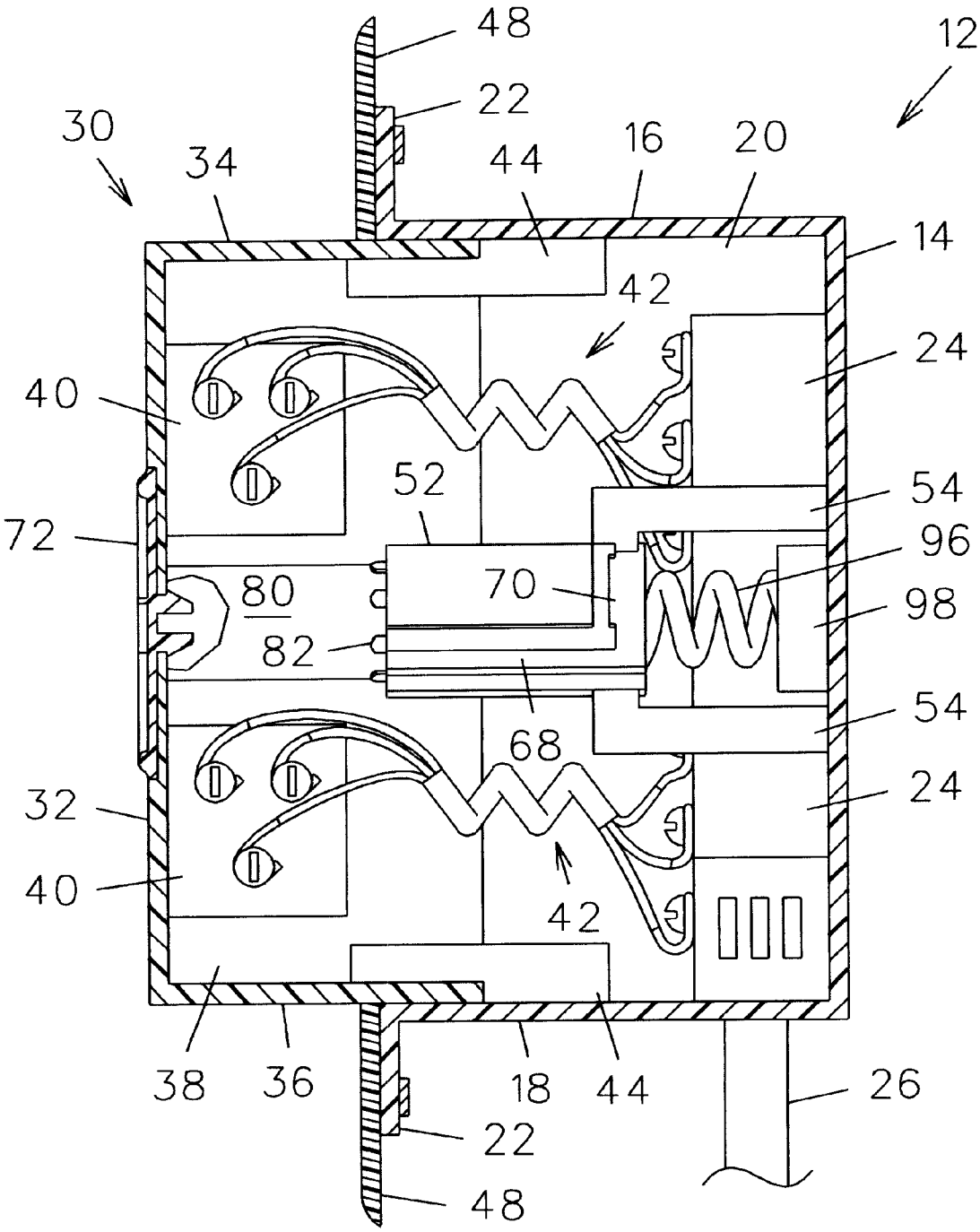
FIG. 4 is a sectional view of the wall outlet taken along line 4—4 of FIG. 1.
Figure 5:
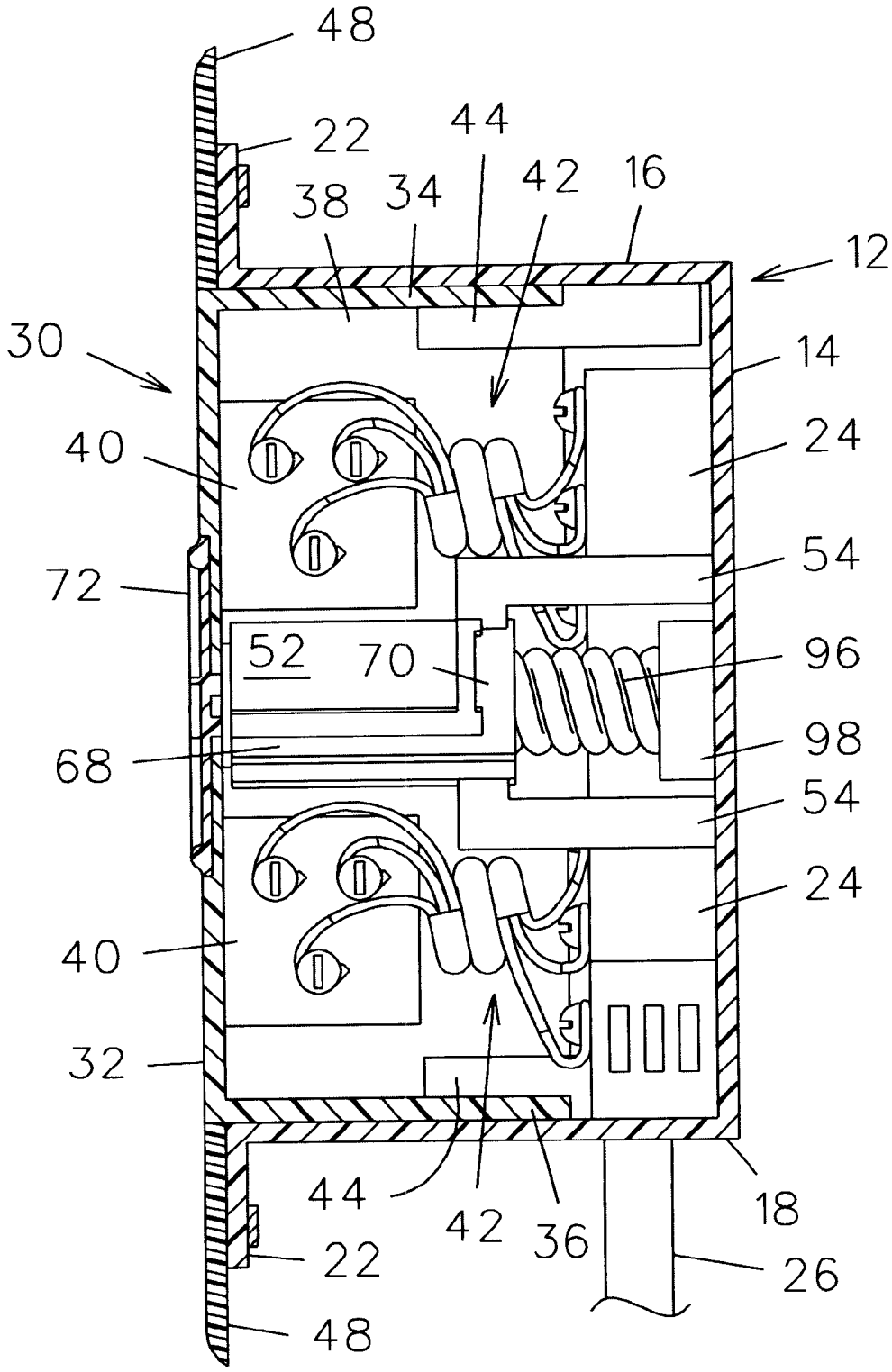
FIG. 5 is a sectional view of the wall outlet taken long line 5—5 of FIG. 2.

The wall outlet assembly 10 further includes an electrical box 30 having a front plate 32 and top 34, bottom 36, and side 38 walls extending rearwardly therefrom (FIG. 1) so as to define an open back and an interior space (FIG. 4). The electrical box 30 preferably includes a pair of electrical plug receptacles 40 mounted along each side wall 38 (FIGS. 1 and 4), although fewer receptacles would also be suitable and they could be positioned along top or bottom walls. For that reason, all electrical box walls will hereafter be referred to generically as electrical box side walls. Positive, negative, and ground terminals of each receptacle 40 are connected with wires 42 to corresponding terminals of respective service wire terminal blocks 24. The side walls of the electrical box 30 define a cross-sectional area that is slightly smaller than a cross-sectional area defined by the side walls of the housing 12 such that the electrical box 30 may be slidably received into or extended from the interior space of the housing, as to be described more fully below. However, the electrical box 30 includes flanges 44 integrally attached to and extending rearwardly from connecting edges of the side walls thereof, the flanges 44 mating with corresponding stops 46 mounted within the housing 12. The stops 46 are positioned approximately midway between the back plate 14 and the open housing front so as to preclude the electrical box 30 from being entirely removed from the housing 12. The wall outlet assembly 10 further includes a rectangular face plate 48 configured to be mounted to a wall structure in a conventional manner. When mounted, the face plate 48 is positioned at the free edges of the housing 12 and defines a rectangular opening 49 through which the electrical box may retract or extend relative to the housing 12, as to be described more fully below.

Figure 2:
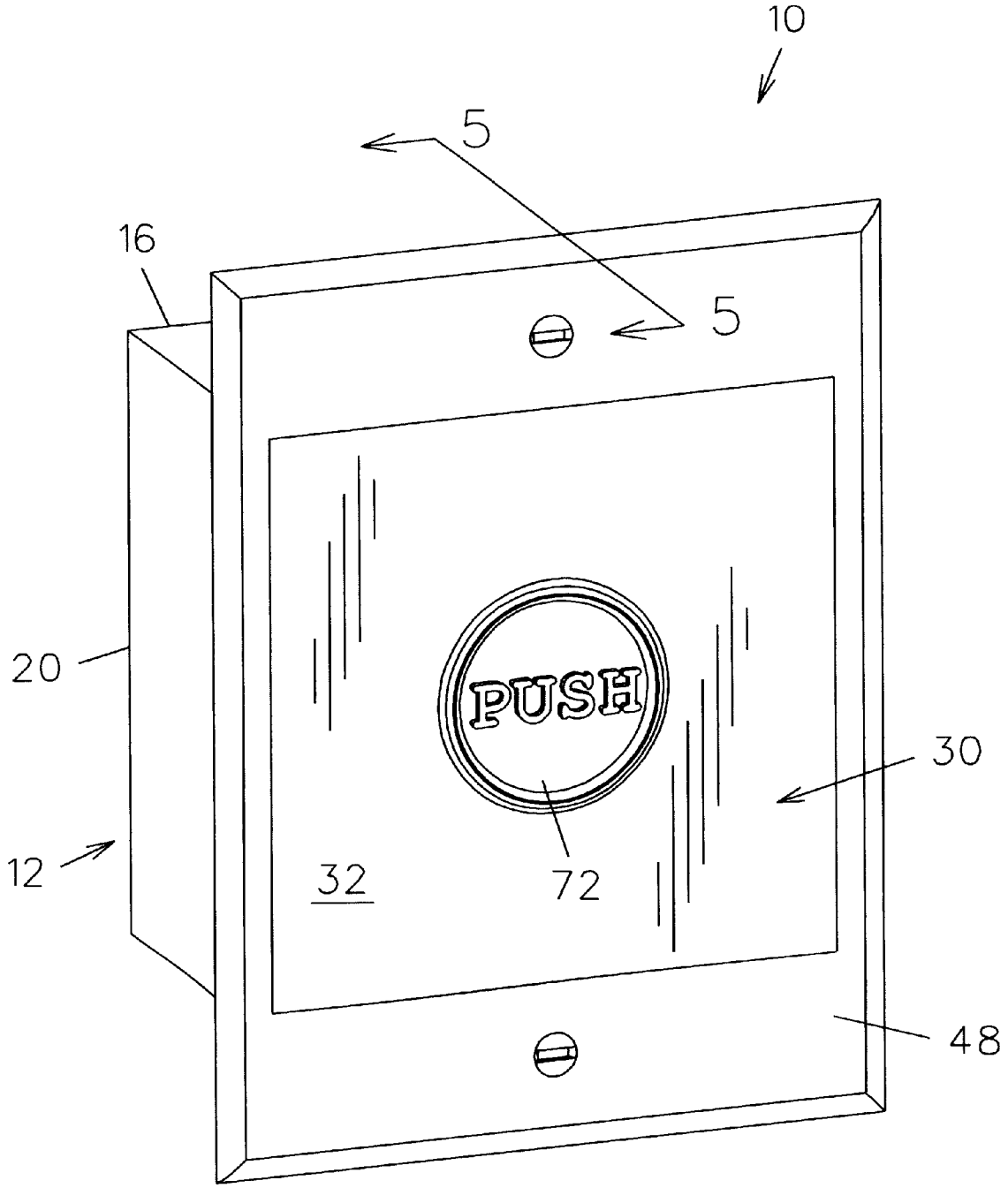
FIG. 2 is a perspective view of the wall outlet as in FIG. 1 in a retracted configuration.
Figure 3:
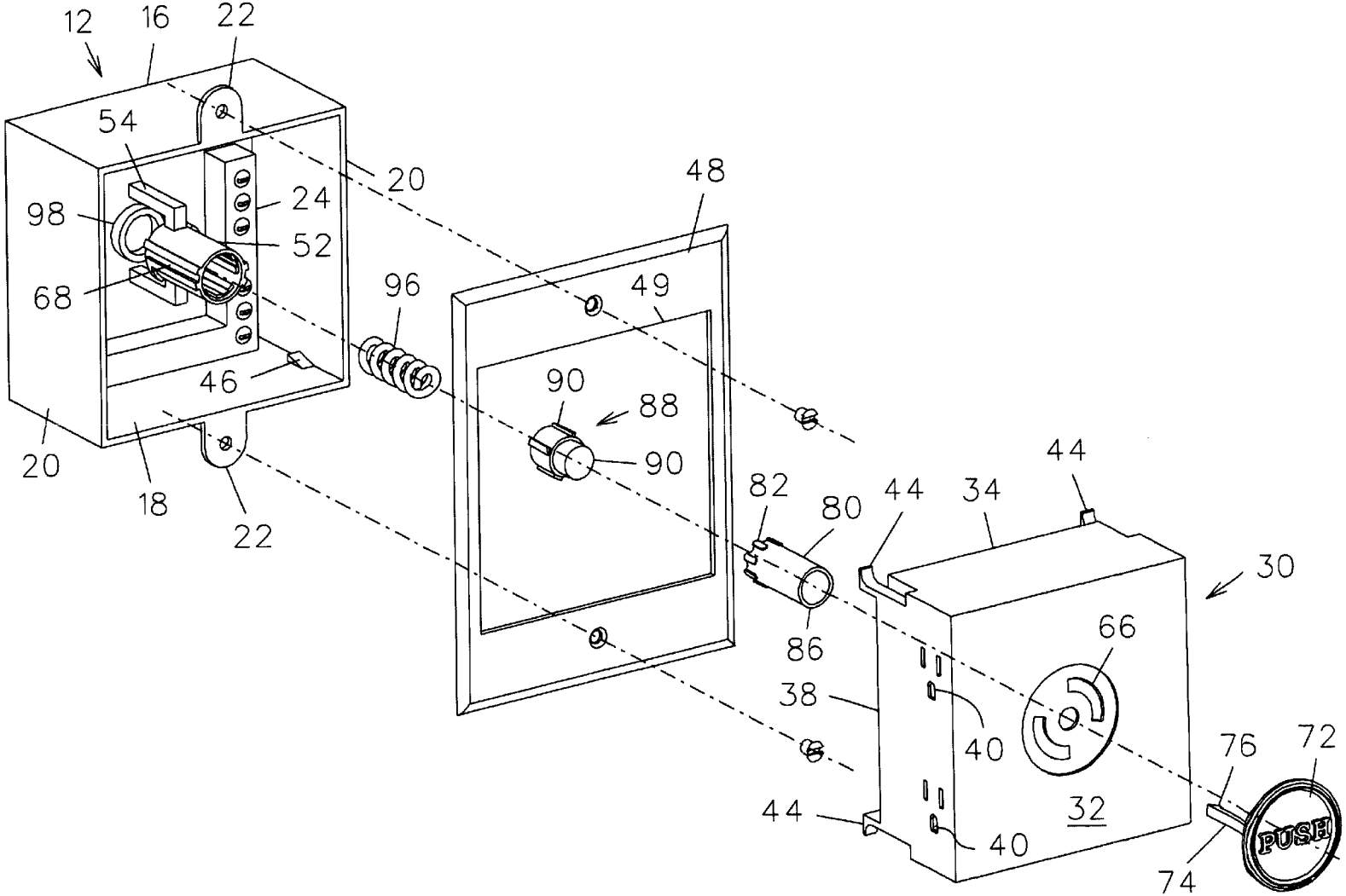
FIG. 3 is an exploded view of the wall outlet as in FIG. 2.
Figure 11:
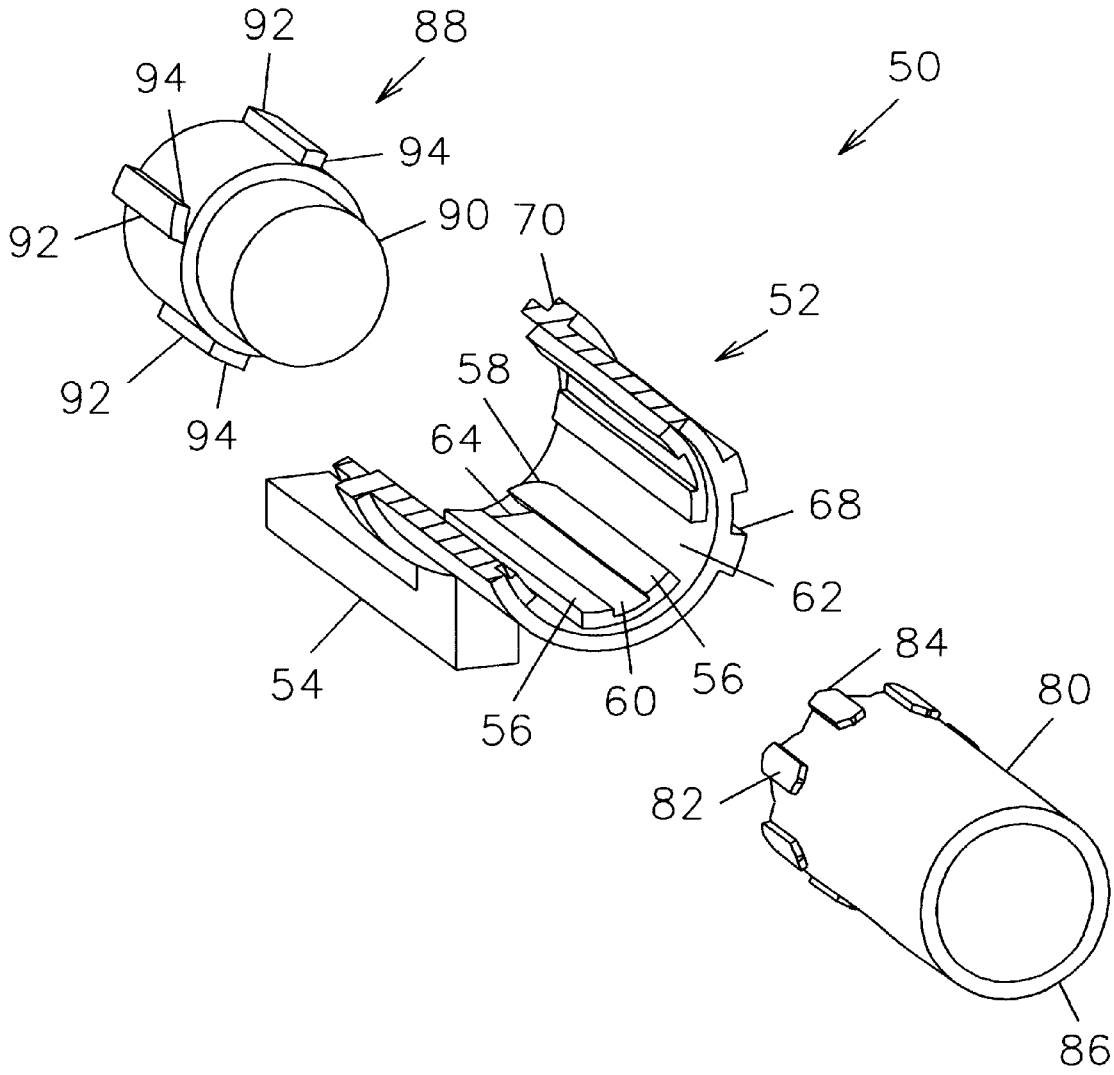
FIG. 11 is an exploded view of an extension/retraction assembly with the cam member illustrated in cross-section.

An extension/retraction assembly 50 couples the electrical box 30 to the housing 12 and enables the electrical box 30 to be selectively moved between a retracted configuration (FIGS. 2 and 5) and an extended configuration (FIGS. 1 and 4). The extension/retraction assembly 50 includes a cylindrical cam member 52 defining opposed open ends that is mounted atop a pair of support legs 54 extending forwardly from the back plate 14 of the housing 12 (FIG. 3). As best shown in FIG. 11, a plurality of spaced apart guide rails 56 extend longitudinally along an interior surface of the cam member 52, the rearward end of each rail terminating with an inclined edge 58. The interior surface of the cam member 52 alternately defines shallow 60 and deep 62 slots, the shallow slots 60 including stops 64 at rearward ends.

The extension/retraction assembly 50 further includes an open-ended cylindrical plunger 80 having a plurality of guide teeth 82 spaced apart about an outer surface adjacent a rearward edge thereof (FIG. 11). The rearward end of each guide tooth 82 also terminates with an inclined edge 84. The plunger guide teeth 82 are dimensioned to slidably mate with respective deep 62 or shallow 60 slots of the cam member 52 and to be guided therealong by said guide rails 56. A forward edge 86 of the plunger 80 is positioned adjacent to the rear surface of the front plate 32 of the electrical box 30.

The extension/retraction assembly 50 further includes a ratchet 88 having a cylindrical stem portion 90 and a set of teeth 92 radially spaced about an outer surface thereof (FIG. 11). The forward end of each ratchet tooth includes an inclined edge 94 dimensioned to engage respective inclined edges of the plunger 80. The ratchet teeth are also dimensioned to slidably mate with the deep 62 and shallow 60 slots of the cam member 52. One end of a compression spring 96 is connected to the back plate 14 of the housing 12 with an opposed end bearing against a rear end of the ratchet 88. The spring 96 may merely be positioned between the back plate 14 and ratchet 88 and guided by a molded ring 98 or may actually be attached to the back plate 14 and ratchet 88. The spring 96 is biased so as to continuously urge the ratchet forward such that the ratchet teeth 92 are urged forwardly through the cam member 52, as to be described more fully below.

The cam member 52 also defines a pair of opposed annular slots 66 extending longitudinally along an outer surface thereof and defines a channel 70 extending transversely partially around the outer surface adjacent a rearward edge thereof in communication with the outer slots 68. A push-button member 72 is rotatably coupled to the front plate and includes a pair of prongs depending therefrom and extending through the opposed annular slots 66. The prongs 74 include respective nubs 76 at terminal ends thereof that are slidable along the outer slots and along the channel 70 when the push-button member 72 is rotated such that the electrical box 30 is locked in a retractable configuration when the nubs 76 are positioned along the channel 70.

In use, the electrical box 30 is retracted or expanded relative to the housing 12 by a user-depression of the push-button member 72 on the front plate 32 thereof. Such a depression causes the front plate to bear against the plunger 80 which in turn causes the plunger teeth 82 to mate with respective deep slots 62 in the cam member 52. Inclined edges 84 of respective plunger teeth 82 engage inclined edges 94 of the ratchet teeth 92 which are positioned forwardly within the cam member 52 as a result of the spring bias. As the push-button member 72 is further depressed, the plunger teeth 82 urge the ratchet teeth 92 rearward along respective rails 56 until the respective teeth follow the inclined edges 58 of the rails and fall into respective adjacent shallow slots 60. The ratchet teeth 92 are retained in the shallow slots 60 as they are biased forward therein and bear against the stops 64. This leaves the electrical box 30 in an inoperative retracted configuration wherein the front plate 32 is flush with the face plate 48 (FIG. 2).

A next consecutive depression of the push-button member 72 again causes the front plate 32 to bear against the plunger 80 which in turn causes respective inclined edges of said plunger teeth 82 to slide through the shallow slots so as to engage inclined edges of respective ratchet teeth being retained by the stops 64. Further depression of the push-button member 72 causes the ratchet teeth 92 to move along respective rails until the ratchet teeth 92 follow the inclined edges 58 of the rails 56 and fall into respective adjacent deep slots 62. The bias of the spring 96 then causes the ratchet teeth 92 to slidably move through the deep slots 62 and force the plunger 80 forward which in turn moves the electrical box 30 to an operative extended configuration displaced from the face plate 48 (FIG. 1). It is understood that only the ratchet 88 rotates in response to depression of the push-button member 72. It is also understood that the plunger teeth 82 are spaced at intervals such that adjacent plunger teeth 82 mate with adjacent deep 62 and shallow 60 slots.

Further, a depression of the push-button member 72 causes the nubs 76 of the prongs 74 to slide along the outer slots 68 of the cam member 52. A subsequent user rotation of the push-button member 72 causes the nubs 76 to slide along the channel 70. At this configuration, the spring 96 is unable to bias the extension/retraction assembly in a forward direction and the wall outlet assembly remains locked until a user rotates the push-button member 72 in an opposite direction.

Figure 7:
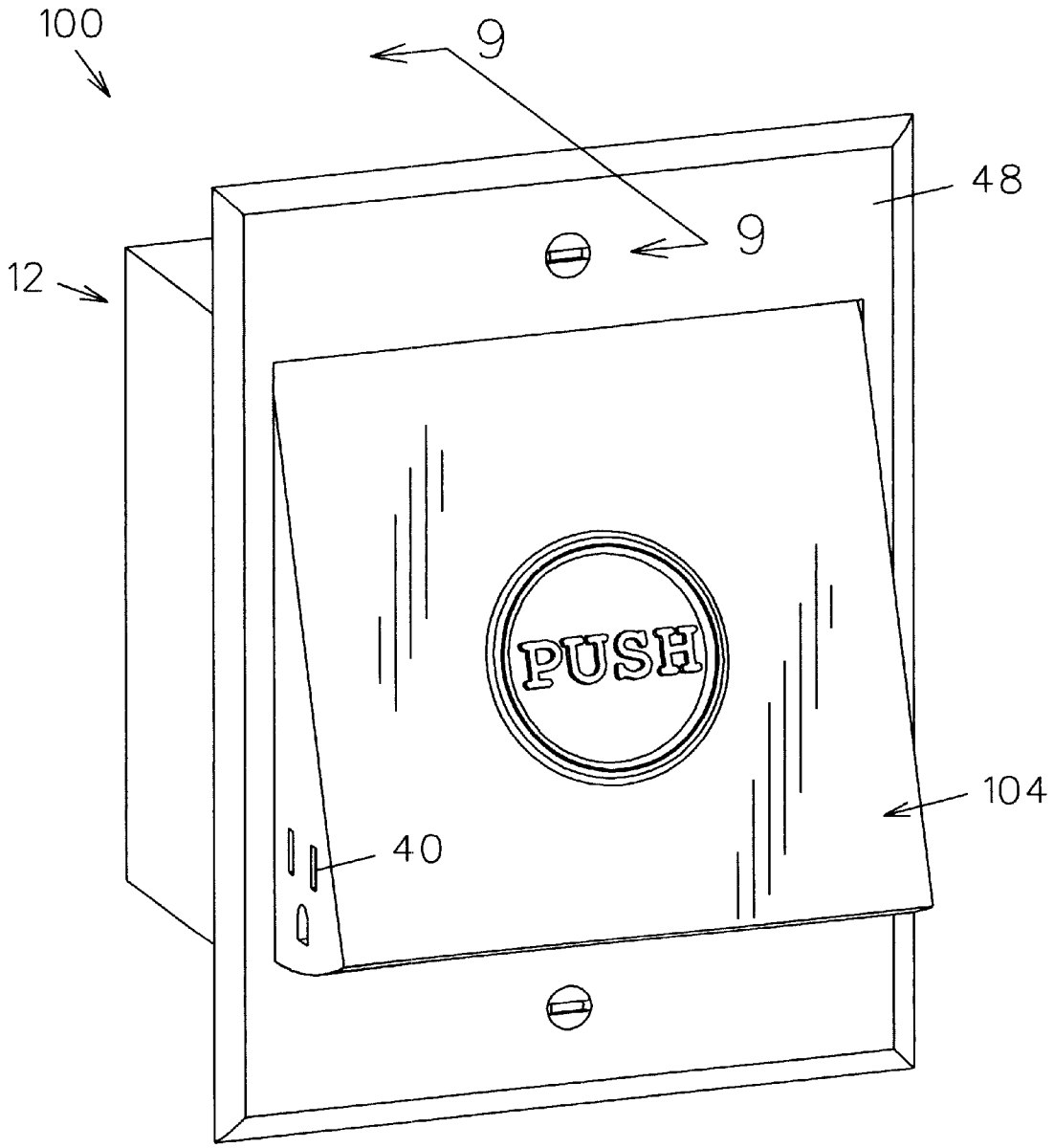
FIG. 7 is a perspective view of an electrical wall outlet according to another embodiment of the present invention in an extended configuration.
Figure 8:
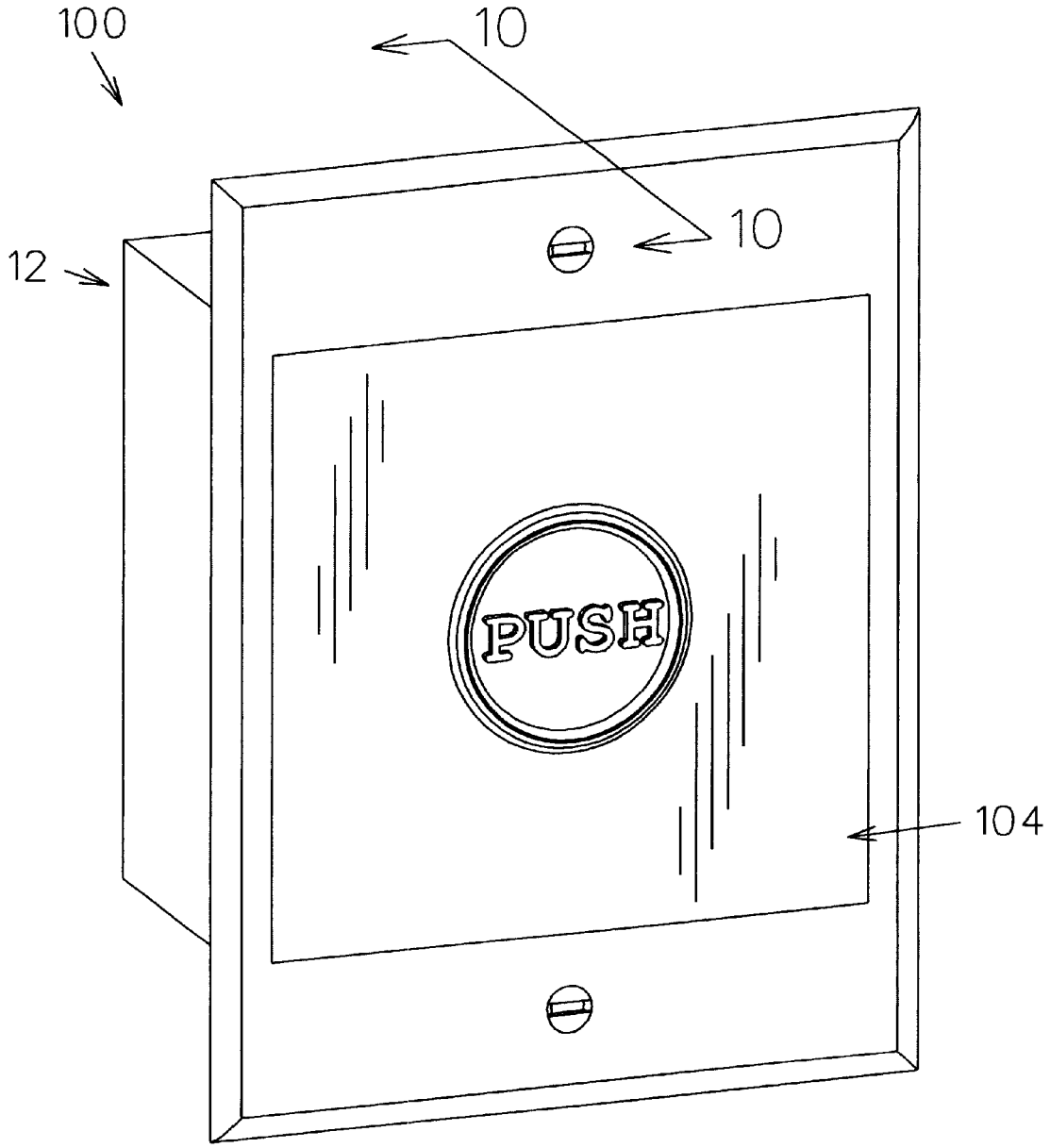
FIG. 8 is a perspective view of the wall outlet as in FIG. 7 in a retracted configuration.
Figure 9:
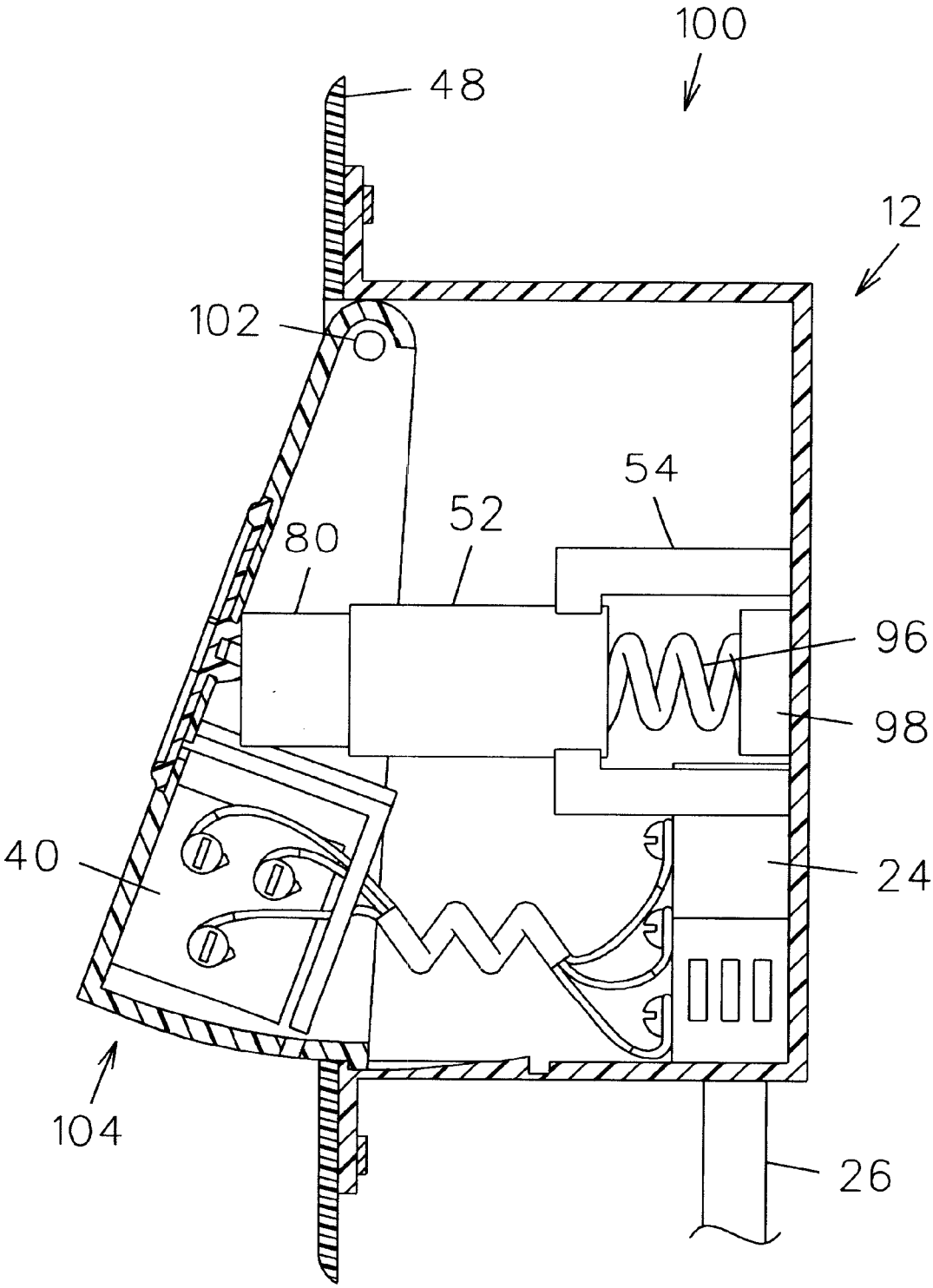
FIG. 9 is a sectional view of a wall outlet taken along line 9—9 of FIG. 7.
Figure 10:
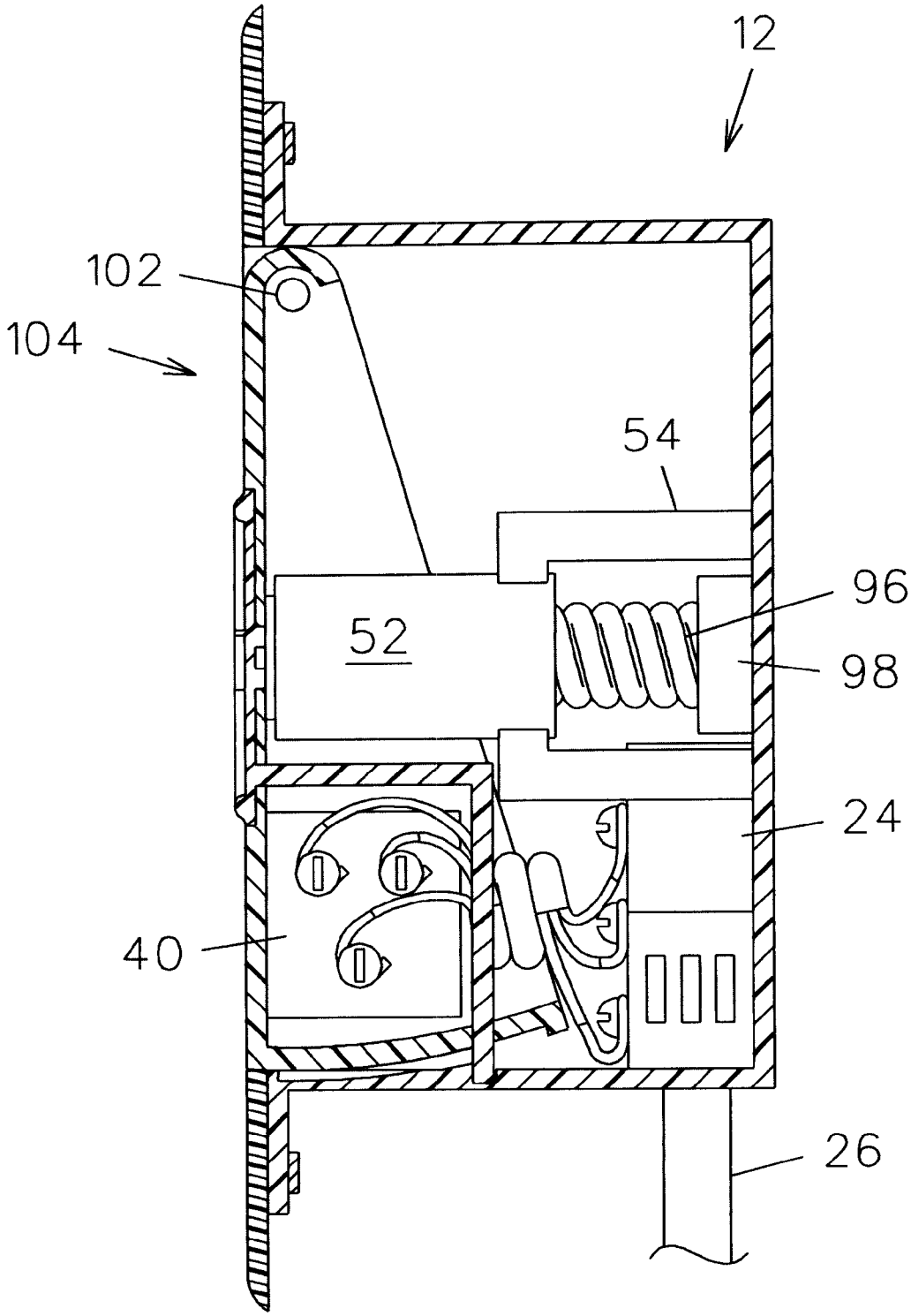
FIG. 10 is a sectional view of a wall outlet taken along line 10—10 of FIG. 8.

Another embodiment 100 of the invention is shown in FIGS. 7 through 10 and includes a construction substantially similar to that described previously except as specifically noted below. In this embodiment, one side wall of an electrical box 104, such as the top side, is pivotally coupled to a corresponding side wall of the housing 12 with a hinge 102 such that the electrical box 104 may only be partially extended upon an operation of the extension/retraction assembly 50 (FIG. 7). However, the retraction and locking elements operate as described previously (FIG. 8). Further, only one plug receptacle 40 is mounted along each side wall.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A retractable electric wall outlet assembly, comprising:

a housing having a back plate and side walls normal to said back plate so as to define an open front and an interior space, said side walls adapted to be mounted to a wall structure;

an electrical box having an electrical plug receptacle, said electrical box being coupled to said housing and adapted to move between an inoperative configuration retracted within said interior space of said housing and an operative configuration extending from said open front;

a cam member mounted in said interior space and spaced from said back plate, said cam member having a plurality of spaced apart guide rails extending longitudinally along an inner surface thereof and terminating with inclined ends, said cam member alternately defining shallow and deep slots between said rails;

a push-button plunger positioned for contact with said electrical box and dimensioned for positioning within said cam member, said plunger terminating in a plurality of teeth having inclined ends that define engaging surfaces;

a ratchet dimensioned for positioning within said cam member and having a set of teeth on its outer surface, said ratchet teeth having inclined ends configured for engagement with said inclined ends of said plunger teeth;

wherein said shallow and deep slots of said cam member are dimensioned and configured to alternately retain said ratchet teeth therein and to release said ratchet teeth for full longitudinal movement through said cam member upon consecutive operations of said plunger, respectively, whereby one operation of said plunger causes said inclined ends of respective plunger teeth to engage said inclined ends of said ratchet teeth so as to urge said ratchet teeth positioned in respective deep slots along respective inclined edges of said rails and into respective adjacent shallow slots for retention therein so that said electrical box is moved to said retracted configuration, and whereby a consecutive operation of said plunger causes said inclined ends of respective plunger teeth to engage said inclined ends of said ratchet teeth so as to urge said ratchet teeth from respective shallow slots along respective inclined edges of said rails and into respective adjacent deep slots for extension therealong so that said electrical box is moved to said extended configuration.

2. The wall outlet assembly as in claim 1 further comprising a compression spring connected at one end to said back plate and at an opposed end to said ratchet, said spring being biased so as to constantly urge said ratchet and said electrical box toward said operative extended configuration.

3. The wall outlet assembly as in claim 1 wherein said ratchet includes a stem portion dimensioned for insertion through said cam member and into said plunger upon an operation of said plunger, said stem portion acting to align respective inclined ends of said ratchet and plunger teeth for engagement thereof.

4. The wall outlet assembly as in claim 1 wherein said cam member includes a cylindrical configuration defining open ends, each shallow slot defining an inclined stop adjacent said inclined ends of adjacent rails for retaining respective ratchet teeth therein.

5. The wall outlet assembly as in claim 1 wherein:

said electrical box includes a front plate defining a pair of opposed annular slots;

said cam member defines a pair of opposed slots extending longitudinally along an outer surface thereof and a channel extending transversely partially around a rearward edge of said cam member in communication with said outer slots; and said wall outlet assembly further comprising a button member having a pair of prongs adapted to extend through said annular slots, terminal ends of said prongs having nubs slidable in respective outer slots upon a depression of said button member, said channel providing a course for movement of respective nubs therealong upon a user rotation of said button member, whereby said electrical box is locked in said inoperative retracted configuration when said nubs of said terminal ends of said prongs are positioned along said channel.

6. The wall outlet assembly as in claim 1 further comprising a face plate adapted to be mounted to a wall structure and positioned at free edges of said housing, said face plate defining a rectangular opening for allowing said electrical box to retract and extend therethrough; and wherein said electrical box includes a front plate that lies flush with said face plate at said inoperative retracted configuration and is displaced and parallel to said face plate at said operative extended configuration.

7. The wall outlet assembly as in claim 1 wherein said electrical box includes a generally rectangular front plate and side walls normal to said front plate so as to define an open back, said electrical box being dimensioned to be received open-back first in said interior space of said housing.

8. The wall outlet assembly as in claim 7 wherein one of said side walls of said electrical box is hingedly coupled to a corresponding side wall of said housing so that a portion of said electrical box is movable between said inoperative retracted configuration and said operative extended configuration, said electrical plug receptacle positioned in said electrical box so as to be exposed at said operative extended configuration.

9. A retractable electric wall outlet assembly, comprising:

a housing having a back plate and side walls normal to said back plate so as to define an open front and an interior space, said side walls adapted to be mounted to a wall structure;

an electrical box having a generally rectangular front plate and side walls normal to said front plate so as to define an open back and being dimensioned to be received in said interior space of said housing, said electrical box having at least a pair of electrical plug receptacles, said electrical box being coupled to said housing and adapted to move between an inoperative configuration retracted within said interior space of said housing and an operative configuration extending from said open front;

means for moving said electrical box between said inoperative retracted configuration and said operative extended configuration;

means for selectively locking and unlocking said electrical box at said inoperative retracted configuration;

wherein said moving means comprises:

a cam member mounted upon a pair of legs attached to said back plate in said interior space, said cam member having a plurality of spaced apart guide rails extending longitudinally along an inner surface thereof and terminating with inclined ends, said cam member alternately defining shallow and deep slots between said rails;

a push-button plunger positioned for contact with said electrical box and dimensioned for positioning within said cam member, said plunger terminating in a plurality of teeth having inclined ends that define engaging surfaces;

a ratchet dimensioned for positioning within said cam member and having a set of teeth on its outer surface, said ratchet teeth having inclined ends configured for engagement with said inclined ends of said plunger teeth;

wherein said shallow and deep slots of said cam member are dimensioned and configured to alternately retain said ratchet teeth therein and to release said ratchet teeth for full longitudinal movement through said cam member upon consecutive operations of said plunger, respectively, whereby one operation of said plunger causes said inclined ends of respective plunger teeth to engage said inclined ends of said ratchet teeth so as to urge said ratchet teeth positioned in respective deep slots along respective inclined edges of said rails and into respective adjacent shallow slots for retention therein so that said electrical box is moved to said retracted configuration, and whereby a consecutive operation of said plunger causes said inclined ends of respective plunger teeth to engage said inclined ends of said ratchet teeth so as to urge said ratchet teeth from respective shallow slots along respective inclined edges of said rails and into respective adjacent deep slots for extension therealong so that said electrical box is moved to said extended configuration.

10. The wall outlet assembly as in claim 9 wherein said front plate defines a pair of opposed annular slots and said locking means comprising:

said cam member defining a pair of opposed slots extending longitudinally along an outer surface thereof and a channel extending transversely partially around a rearward edge of said cam member in communication with said outer slots;

a button member having a pair of prongs adapted to extend through said annular slots, terminal ends of said prongs having nubs slidable in respective outer slots of said cam member upon a depression of said button member, said channel providing a course for movement of respective nubs therealong upon a user rotation of said button member, whereby said electrical box is locked in said inoperative retracted configuration when said nubs of said terminal ends of said prongs are positioned along said channel.

11. The wall outlet assembly as in claim 9 further comprising a face plate adapted to be mounted to a wall structure and positioned at free edges of said housing, said face plate defining a rectangular opening for allowing said electrical box to retract and extend therethrough;

wherein said front plate of said electrical box lies flush with said face plate at said inoperative retracted configuration and is displaced and parallel to said face plate at said operative extended configuration.

12. The wall outlet assembly as in claim 10 further comprising a compression spring connected at one end to said back plate and at an opposed end to said ratchet, said spring being biased so as to constantly urge said ratchet and said electrical box toward said operative extended configuration.

13. The wall outlet assembly as in claim 10 wherein said ratchet includes a stem portion dimensioned for insertion through said cam member and into said plunger upon an operation of said plunger, said stem portion acting to align respective inclined ends of said ratchet and plunger teeth for engagement thereof.

14. The wall outlet assembly as in claim 10 wherein said cam member includes a cylindrical configuration defining open ends, each shallow slot defining an inclined stop adjacent said inclined ends of respective adjacent rails for retaining respective ratchet teeth therein.

15. The wall outlet assembly as in claim 9 wherein one of said side walls of said electrical box is pivotally coupled to a corresponding side wall of said housing such that a portion of said electrical box is movable between said inoperative retracted configuration and said operative extended configuration, said at least one electrical plug receptacle being positioned in said electrical box so as to be exposed at said operative extended configuration.

16. A retractable electric wall outlet assembly, comprising:

a housing having a back plate and side walls normal to said back plate so as to define an open front and an interior space, said side walls adapted to be mounted to a wall structure;

an electrical box having an electrical plug receptacle, said electrical box being coupled to said housing and adapted to move between an inoperative configuration retracted within said interior space of said housing and an operative configuration extending from said open front;

a cam member mounted in said interior space and spaced from said back plate, said cam member having a plurality of spaced apart guide rails extending longitudinally along an inner surface thereof and terminating with inclined ends, said cam member alternately defining shallow and deep slots between said rails;

a push-button plunger positioned for contact with said electrical box and dimensioned for positioning within said cam member, said plunger terminating in a plurality of teeth having inclined ends that define engaging surfaces;

a ratchet dimensioned for positioning within said cam member and having a set of teeth on its outer surface, said ratchet teeth having inclined ends configured for engagement with said inclined ends of said plunger teeth;

means for biasing said ratchet toward said operative extended configuration;

wherein said shallow and deep slots of said cam member are dimensioned and configured to alternately retain said ratchet teeth therein and to release said ratchet teeth for full longitudinal movement through said cam member upon consecutive operations of said plunger, respectively, whereby one operation of said plunger causes said inclined ends of respective plunger teeth to engage said inclined ends of said ratchet teeth so as to urge said ratchet teeth positioned in respective deep slots along respective inclined edges of said rails and into respective adjacent shallow slots for retention therein so that said electrical box is moved to said retracted configuration, and whereby a consecutive operation of said plunger causes said inclined ends of respective plunger teeth to engage said inclined ends of said ratchet teeth so as to urge said ratchet teeth from respective shallow slots along respective inclined edges of said rails and into respective adjacent deep slots for extension therealong so that said biasing means urges said ratchet to engage said plunger and thereby move said electrical box to said extended configuration.

17. The wall outlet assembly as in claim 16 wherein said biasing means is a compression spring connected at one end to said back plate and at an opposed end to said ratchet.

* * * * *